US008616260B2

(12) United States Patent
Zhang

(10) Patent No.: US 8,616,260 B2
(45) Date of Patent: Dec. 31, 2013

(54) HOLLOW BUILT-IN WINDOW BLIND

(75) Inventor: Xuezhong Zhang, Shanghai (CN)

(73) Assignee: Shanghai King Hua IG Blinds Co., Ltd., Jiangshu Province (CN)

( * ) Notice: Subject to any disclaimer, the term of this patent is extended or adjusted under 35 U.S.C. 154(b) by 0 days.

(21) Appl. No.: 13/321,512

(22) PCT Filed: May 12, 2010

(86) PCT No.: PCT/CN2010/072676

§ 371 (c)(1),
(2), (4) Date: Nov. 18, 2011

(87) PCT Pub. No.: WO2010/133144

PCT Pub. Date: Nov. 25, 2010

(65) Prior Publication Data

US 2012/0061031 A1 Mar. 15, 2012

(30) Foreign Application Priority Data

May 22, 2009 (CN) ..... 2009 2 0072816 U

(51) Int. Cl.
*E06B 9/264* (2006.01)

(52) U.S. Cl.
USPC ..... 160/107; 160/170

(58) Field of Classification Search
USPC ..... 160/107, 170, 171, 191, 192, 193
See application file for complete search history.

(56) References Cited

U.S. PATENT DOCUMENTS

| | | | | |
|---|---|---|---|---|
| 812,722 | A * | 2/1906 | Cahill | 160/116 |
| 2,276,716 | A * | 3/1942 | Cardona | 160/170 |
| 2,420,301 | A * | 5/1947 | Cusumano | 160/170 |
| 2,758,644 | A * | 8/1956 | Virlouvet | 160/170 |
| 3,141,497 | A * | 7/1964 | Griesser | 160/170 |
| 3,352,349 | A * | 11/1967 | Hennequin | 160/171 |
| 5,113,922 | A * | 5/1992 | Christensen et al. | 160/172 R |
| 5,228,491 | A * | 7/1993 | Rude et al. | 160/171 |
| 5,282,504 | A * | 2/1994 | Anderson et al. | 160/107 |
| 5,628,356 | A * | 5/1997 | Marocco | 160/170 |
| 6,116,323 | A * | 9/2000 | Huang | 160/170 |
| 6,601,633 | B2 * | 8/2003 | Sun et al. | 160/107 |
| 6,622,769 | B2 * | 9/2003 | Judkins | 160/84.05 |
| 6,655,441 | B2 * | 12/2003 | Wen et al. | 160/168.1 P |

(Continued)

FOREIGN PATENT DOCUMENTS

| | | |
|---|---|---|
| CN | 200971738 Y | 11/2007 |
| CN | 101230774 A | 7/2008 |

OTHER PUBLICATIONS

IPRP/WO for related PCT/CN2010/072676 dated Nov. 22, 2011; and its English translation.

*Primary Examiner* — David Purol

(74) *Attorney, Agent, or Firm* — Ladas & Parry, LLP

(57) ABSTRACT

A hollow built-in window blind is provided. The window blind includes an outer glass (13*a*), an inner glass (13*b*), a spacing strip (14), a curtain (12), and a fixing device for the curtain. The curtain (12) is installed in a closed space enclosed by the outer glass (13*a*), the inner glass (13*b*), and the spacing strip (14). Furthermore, the spacing strip (14) has a step part to be connected with the curtain (12), and the fixing device includes an upper beam (1) with a projection, left and right frames (10*a*, 10*b*) with a projection respectively. The upper beam (1), left and the right frames (10*a*, 10*b*) are connected to the spacing strip (14) by the projections set on the step part of the spacing strip (14).

9 Claims, 8 Drawing Sheets

(56) References Cited

U.S. PATENT DOCUMENTS

| | | | | |
|---|---|---|---|---|
| 7,082,982 | B2 * | 8/2006 | Eveland et al. | 160/107 |
| 7,124,803 | B2 * | 10/2006 | Jin et al. | 160/107 |
| 7,137,430 | B2 * | 11/2006 | Fraczek | 160/170 |
| 7,234,501 | B1 * | 6/2007 | Park | 160/107 |
| 7,287,569 | B2 * | 10/2007 | Lin | 160/170 |
| 7,654,300 | B2 * | 2/2010 | Chigusa | 160/170 |
| 2004/0211528 | A1 * | 10/2004 | Jin et al. | 160/107 |
| 2004/0238131 | A1 * | 12/2004 | Eveland et al. | 160/107 |
| 2006/0118250 | A1 * | 6/2006 | Jin et al. | 160/107 |
| 2006/0249264 | A1 * | 11/2006 | Lin | 160/171 |
| 2008/0029226 | A1 * | 2/2008 | Huang | 160/107 |

* cited by examiner

R-portion

F-portion

N-portion

W-portion

D-D

HOLLOW BUILT-IN WINDOW BLIND

TECHNICAL FIELD

This utility model relates to doors and windows, and more particularly to a blind.

BACKGROUND

Because hollow glass blinds have good heat and sound insulations and good sun-shading effect, they are widely used in modern homes. This type of product generally pre-assembled together the blind and the metal spacers, after which the glasses are pieced together. Thus, because of good thermal conductivity of metal, the metal spacers in the structure of this type of hollow blind adversely affect the heat insulation performance of the product. At the same time, since the blind and the metal spacers are pre-assembled together, to implement double sealing on the metal spacers causes great difficulties. Hence, many products only implement single sealing, resulting in higher heat transfer coefficient and lower sealing property of the product.

Further, as the blind of this type of product is raised, the number of stacked slats increases, and friction between the weight of the slats and the pulling system also increases. This leads to increase in the required pulling force as the blind is raised high, and disengagement between a built-in control device and an external control device because of insufficient magnetic force therebetween. Hence, the size of this type of hollow blind has great limitation.

CONTENT OF THE INVENTION

The purpose of this utility model is to resolve the aforesaid technical problem by providing a hollow built-in blind that uses non-metal spacers to enhance heat insulation property thereof. This utility model is easy to assemble, has good heat insulating effect, and can roll up large size of blind with less effort.

This utility model is achieved this way: A hollow built-in blind includes an outer glass, an inner glass, a spacer and a blind. The blind is installed in a closed space cooperatively defined by the outer glass, the inner glass and the spacer. The spacer has a cross section with a stepped portion for connection with the aforesaid blind.

The blind includes a fixing device. The fixing device includes an upper rail having a cross section with a projection, and left and right frames each having a cross section with a projection. The projections of the upper rail and the left and right frames of the blind are placed on the stepped portion of the spacer and are connected to the spacer.

The spacer has a surface coated with adhesive for interconnecting the inner glass, the outer glass and the fixing device of the blind.

The blind further includes:

- a drive device including a plurality of cord-winding devices, a plurality of rope ladder turning mechanisms, a plurality of bearings and bearing seats to support the cord-winding devices, a tapered balance cord-reeling device wound with a balance pull cord, and a drive shaft to interconnect a blind actuating device, the cord-winding devices, and the tapered balance cord-reeling device;
- the cord-winding devices, the bearings and the bearing seats, the tapered balance cord-reeling device, and the drive shaft being disposed in a cavity of the upper rail;
- an actuating device disposed in a cavity of the right frame and including two belt pulleys, a synchronous belt, and a built-in control device, the synchronous belt having two ends connected to two ends of the built-in control device to form a ring, thereby interconnecting the belt pulleys;
- a lower rail, a slat-collecting groove, and a set of slats successively interconnected using a pull cord, one end of the pull cord being connected to the lower rail and extending through the slats to connect with the cord-winding device.

Each of the upper rail, the left frame and the right frame has a U-shaped groove structure, and forms a rectangular cavity structure with a cover plate to receive the drive device and the actuating device.

The balance pull cord has one end fixed to a large diameter end of the tapered balance cord-reeling device, and the other end that passes through a constant spring seat to connect with a constant spring, the constant spring having an inner ring connected to the constant spring seat, and an outer ring fixed to the left frame.

The blind further includes a rope ladder turning mechanism sleeved on a small protruding shaft of the cord-winding device, the rope ladder turning mechanism mainly including a torsion spring and a rope ladder fixing ring sleeved on and abutting against a bearing of the cord-winding device, the torsion spring having two ends that are free ends and that can rotate when actuated by the cord-winding device, the rope ladder fixing ring being actuated by the torsion spring, the bearing seat including a bottom seat frame and an annular sleeve connected to the bottom seat frame to receive the bearing, two connection locations of the annular sleeve that are proximate to a bottom portion of the torsion spring and the bottom seat frame being provided with two limiting pieces having definite widths to limit angular rotation of the two free ends of the torsion spring.

The blind actuating device includes a motor and a control circuit board.

The blind actuating device includes a magnetic drive mechanism.

BRIEF DESCRIPTION OF DRAWINGS

Below illustrates concrete implementation of this utility model in conjunction with the drawings.

EMBODIMENT

Figure 1:
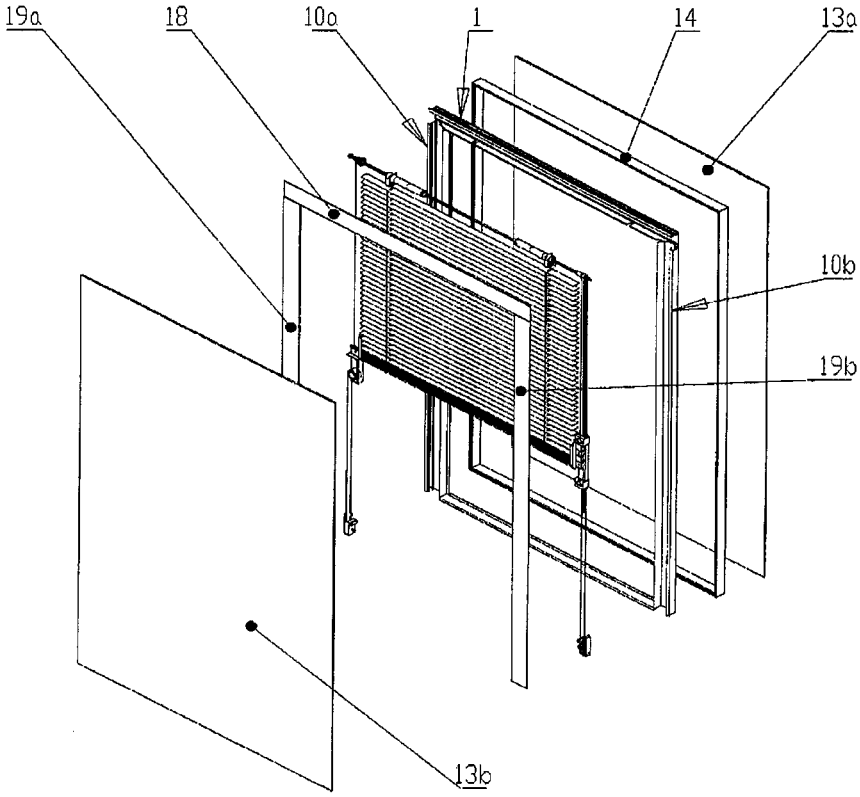
FIG. 1 is a schematic view of an embodiment of this utility model.

As shown in FIG. 1, a hollow built-in blind includes an outer glass (13*a*), an inner glass (13*b*), a spacer 14 and a blind 12. The blind 12 is installed in a closed space cooperatively defined by the outer glass (13*a*), the inner glass (13*b*) and the spacer 14. The spacer 14 has a cross section with a stepped portion for connection with the aforesaid blind 12.

Figure 2:
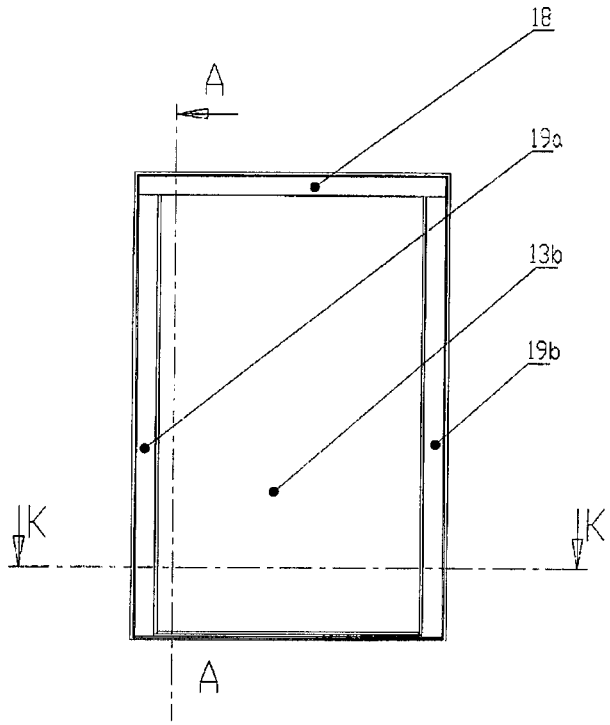
FIG. 2 is a front view of a fixing device of the aforesaid blind.
Figure 3:
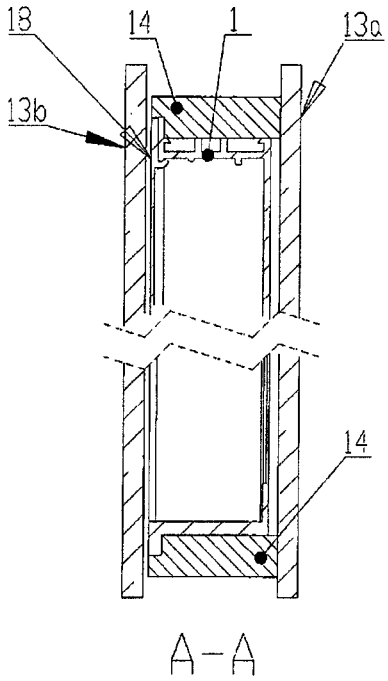
FIG. 3 is a sectional view taken along line A-A of FIG. 2.
Figure 4:
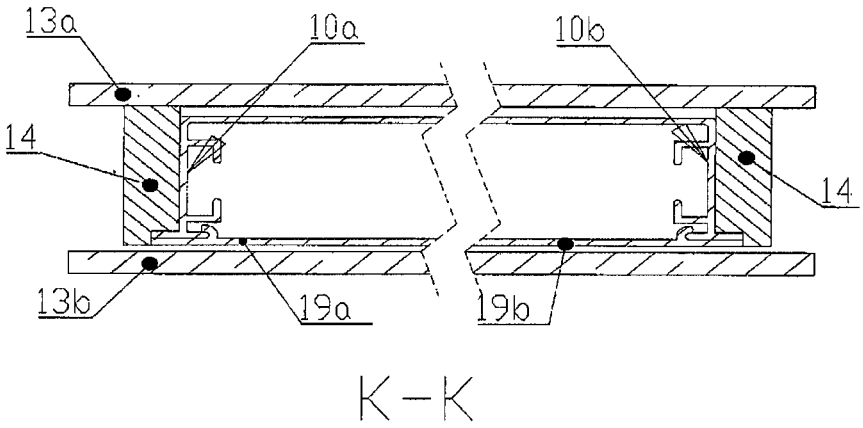
FIG. 4 is a sectional view taken along line K-K of FIG. 2.
Figure 5:
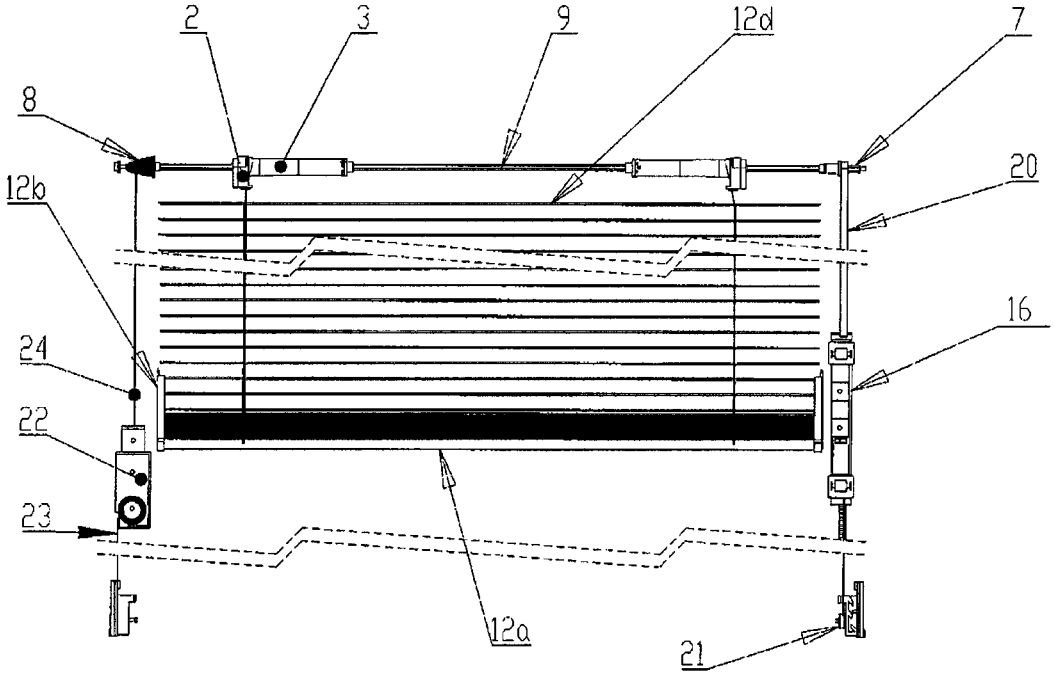
FIG. 5 is a front view of an internal structure of the aforesaid blind.
Figure 6:
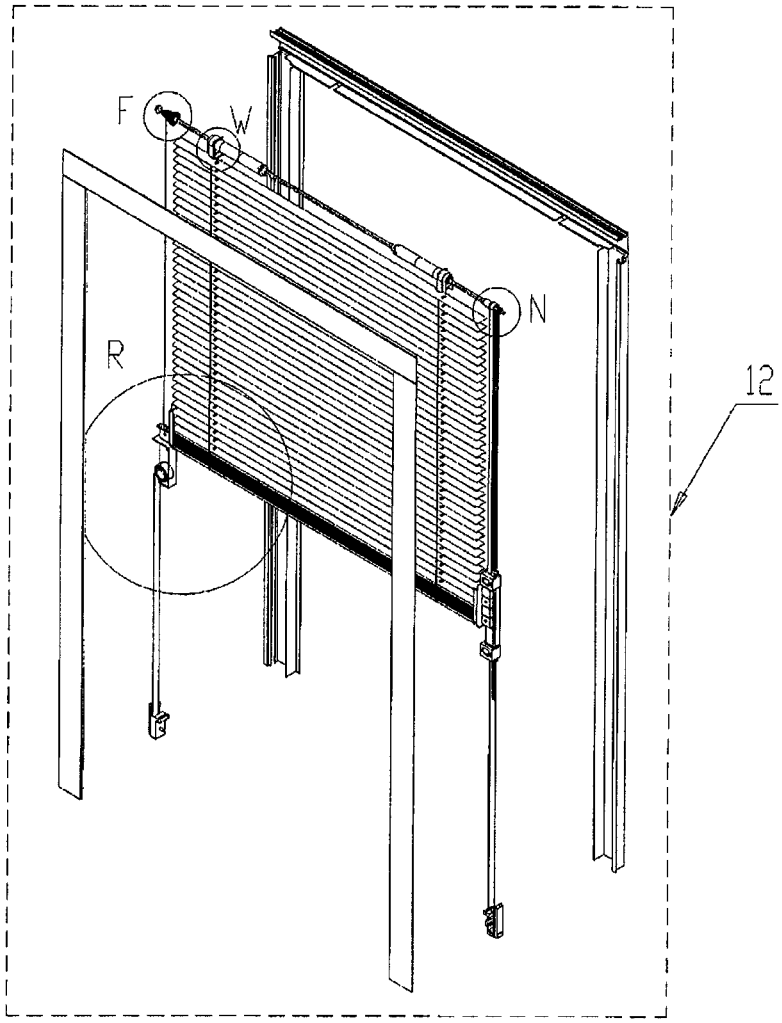
FIG. 6 is an axial side view of the aforesaid blind.
Figure 7:
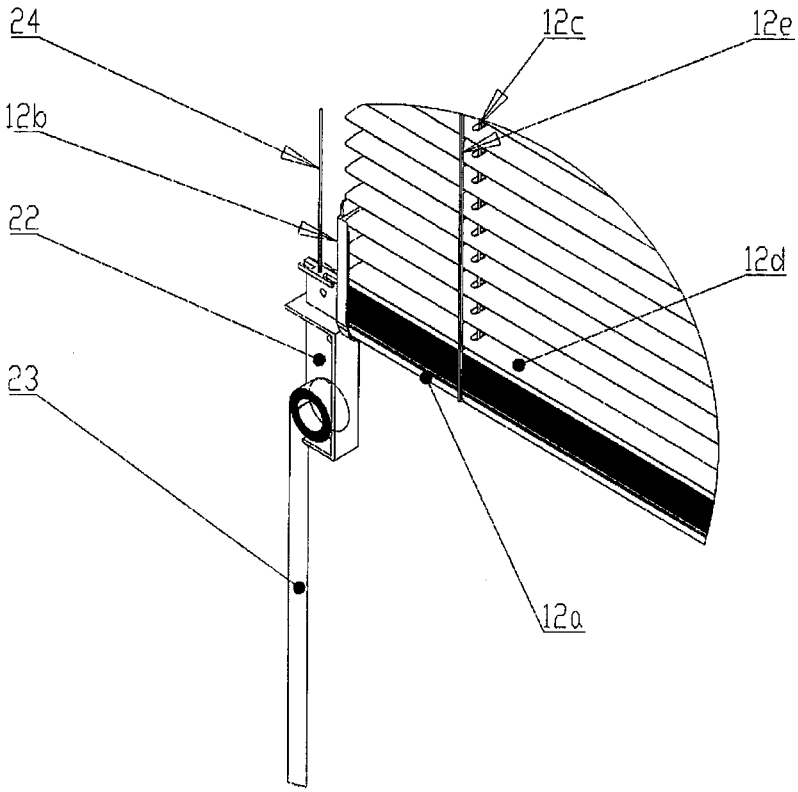
FIG. 7 is an enlarged perspective view of an R-portion of FIG. 6.
Figure 8:
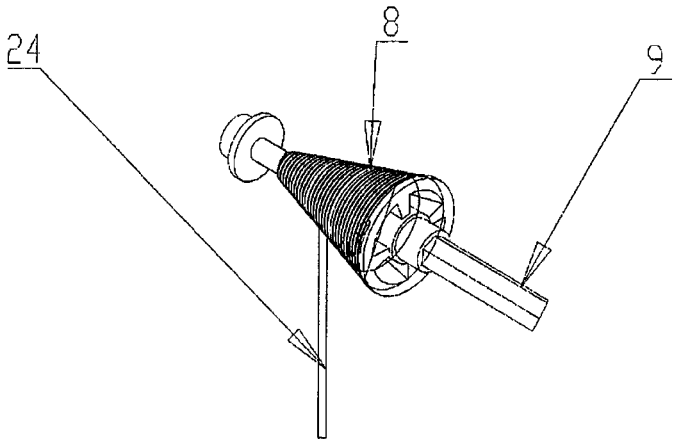
FIG. 8 is an enlarged perspective view of an F-portion of FIG. 6.
Figure 9:
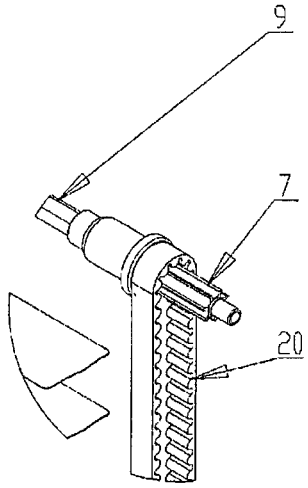
FIG. 9 is an enlarged perspective view of an N-portion of FIG. 6.
Figure 10:
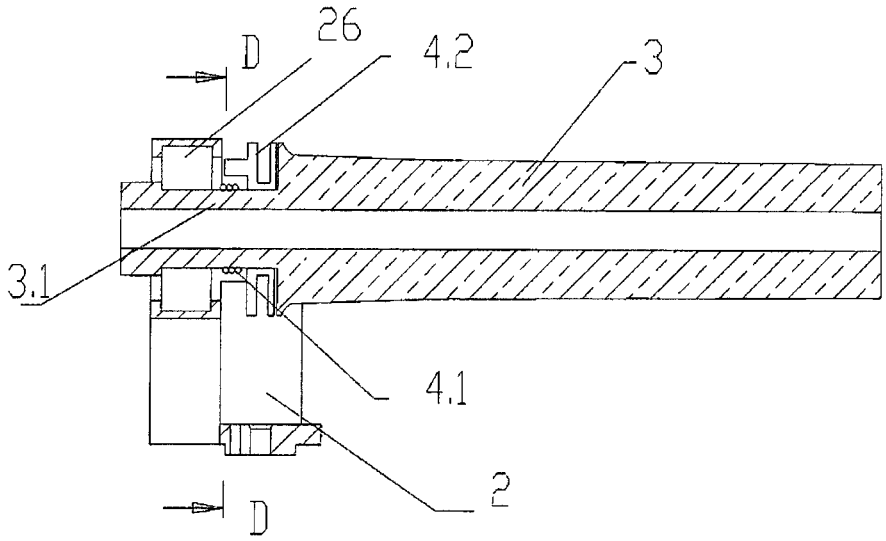
FIG. 10 is an enlarged perspective view of a W-portion of FIG. 6.
Figure 11:
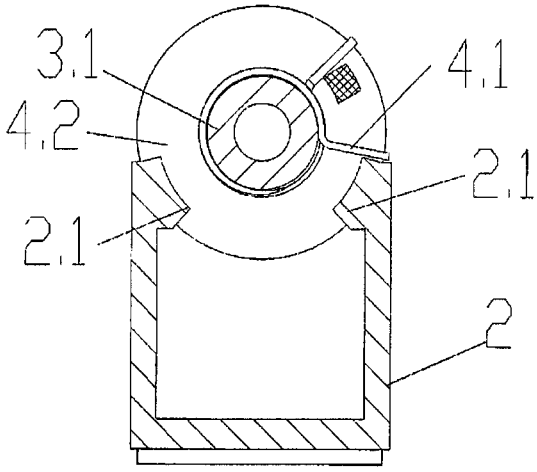
FIG. 11 is a sectional view taken along line D-D of FIG. 10.

With reference to FIGS. 2, 3 and 4, the blind 12 includes a fixing device. The fixing device includes an upper rail 1 having a cross section with a projection, and left and right frames (10*a*, 10*b*) each having a cross section with a projection. The projections of the upper rail 1 and the left and right frames (10*a*, 10*b*) of the blind 12 are placed on the stepped portion of the spacer 14 and are connected to the spacer 14.

The spacer 14 is made of a composite plastic material, and has a surface coated with adhesive for interconnecting the inner glass (13*b*), the outer glass (13*a*), and the fixing device of the blind 12.

With reference to FIGS. 5 to 11, the blind 12 includes:

a drive device (see FIGS. 5, 6 and 8) including a plurality of cord-winding devices 3, a plurality of rope ladder turning mechanisms 4, a plurality of bearings 26 and bearing seats 2 to support the cord-winding devices 3, a tapered balance cord-reeling device 8 wound with a balance pull cord 24, and a drive shaft 9 to interconnect a blind actuating device, the cord-winding devices 3, and the tapered balance cord-reeling device 8;

the aforesaid cord-winding devices 3, the bearings 26 and the bearing seats 2, the tapered balance cord-reeling device 8, and the drive shaft 9 are disposed in a cavity of the upper rail 1; and a blind actuating device (see FIGS. 5, 6 and 9) disposed in a cavity of the right frame (10*b*) and including a belt pulley 7, a synchronous belt 20, a built-in control device 16, and a belt pulley 21, the aforesaid synchronous belt 20 having two ends connected to two ends of the built-in control device 16 to form a ring, thereby interconnecting the belt pulley 21 and the belt pulley 7.

Referring again to FIGS. 5 and 6, the blind 12 further includes a lower rail (12*a*), a slat-collecting groove (12*b*), and a set of slats (12*d*) successively interconnected using a pull cord (12*c*); one end of the pull cord (12*c*) is connected to the lower rail (12*a*), and extends through the slats (12*d*) to connect with the cord-winding device 3.

In the aforesaid hollow built-in blind, each of the aforesaid upper rail 1, the left frame (10*a*) and the right frame (10*b*) has a U-shaped groove structure, and forms a rectangular cavity structure with a respective one of PVC cover plate (18), PVC cover plate (19*a*) and PVC cover plate (19*b*) to receive the aforesaid drive device and the blind actuating device (see FIGS. 2 to 4).

In the aforesaid hollow built-in blind, the balance pull cord 24 has one end fixed to a large diameter end of the tapered balance cord-reeling device 8, and the other end that passes through a constant spring seat 22 to connect with a constant spring 23. The constant spring 23 has an inner ring connected to the constant spring seat 22, and an outer ring fixed to the left frame (10*a*) (see FIG. 8).

The blind 12 further includes a rope ladder turning mechanism 4 sleeved on a small protruding shaft (3.1) of the cord-winding device 3. The rope ladder turning mechanism 4 mainly includes a torsion spring (4.1) and a rope ladder fixing ring (4.2) sleeved on and abutting against a bearing 26 of the cord-winding device 3. The torsion spring (4.1) has two ends that are free ends and that can rotate when actuated by the cord-winding device 3. The rope ladder fixing ring (4.2) is actuated by the torsion spring (4.1) (see FIGS. 9 and 10);

The aforesaid bearing seat 2 includes a bottom seat frame and an annular sleeve connected to the bottom seat frame for receiving the bearing 26. Two connection locations of the annular sleeve that are respectively proximate to a bottom portion of the torsion spring (4.1) and the bottom seat frame are provided with two limiting pieces (2.1) having definite widths to limit angular rotation of the two free ends of the torsion spring (4.1). A rope ladder (12*e*) that drives the blind slats (12*d*) to turn has an upper end fixed to the rope ladder fixing ring (4.2), the rope ladder fixing ring (4.2) actuates and achieves the turning of the aforesaid blind slats (12*d*).

The aforesaid hollow built-in blind may be electrically actuated, and may be manually actuated, the actuating mechanism includes a motor and a control circuit board and may be a magnetic drive mechanism.

The ordinary person skilled in the arts of this technical field should recognize that the aforesaid embodiment and principle are only used to describe this utility model, and is not used as a limitation to this utility model. As long as it is within the range of the real spirit of this utility model, modifications and variations to the aforesaid embodiment will fall within the scope of the claims of this utility model.

The invention claimed is:

1. A hollow built-in blind comprising:

an outer glass, an inner glass, a spacer, and a blind, said blind being installed in a closed space cooperatively defined by said outer glass, said inner glass and said spacer, said spacer having a cross section with a stepped portion to connect with said blind;

said blind including a fixing device surrounded by said spacer, said fixing device including an upper rail having a cross section with a projection, and left and right frames each having a cross section with a projection, said spacer having an inner side proximate to said inner glass, an outer side proximate to said outer glass, and a four-sided interior surface in contact with said upper rail and said left and right frames, said interior surface being flat and free of any projection, said interior surface and said inner side being indented to cooperatively form said stepped portion at a junction of said interior surface and said inner side, said projections of said upper rail and said left and right frames of said blind being inserted between said stepped portion of said spacer and said inner glass, and being connected to said spacer;

wherein said blind further includes a drive device including a plurality of cord-winding devices, a plurality of rope ladder turning mechanisms, a plurality of bearings and bearing seats to support said cord-winding devices, a tapered balance cord-reeling device wound with a balance pull cord, and a drive shaft to interconnect a blind actuating device, said cord-winding devices, and said tapered balance cord-reeling device;

wherein each of said upper rail, said left frame, and said right frame has a U-shaped groove structure, and forms a rectangular cavity structure with a cover plate to receive said drive device and said blind actuating device; and wherein said cover plate is proximate to said inner glass and extends partially into said stepped portion and between said inner glass and each of said upper rail and said left and right frames.

2. The hollow built-in blind as claimed in claim 1, wherein said inner side, said outer side, and said interior surface of said spacer are coated with adhesive for interconnecting said inner glass, said outer glass and said fixing device of said blind.

3. The hollow built-in blind as claimed in claim 1, wherein said blind further includes:

a lower rail, a slat-collecting groove, and a set of slats successively interconnected using a pull cord, one end of said pull cord being connected to said lower rail and extending through said slats to connect with said cord-winding device;

wherein said cord-winding devices, said bearings and said bearing seats, said tapered balance cord-reeling device, and said drive shaft are disposed in said cavity structure of said upper rail; and wherein said blind actuating device is disposed in said cavity structure of said right frame and includes two belt pulleys, a synchronous belt, and a built-in control device, said synchronous belt having two ends connected to two ends of said built-in control device to form a ring, thereby interconnecting said belt pulleys.

4. The hollow built-in blind as claimed in claim 1, characterized in that said blind further includes a rope ladder turning mechanism sleeved on a small protruding shaft of said cord-winding device, said rope ladder turning mechanism mainly including a torsion spring and a rope ladder fixing ring sleeved on and abutting against a bearing of said cord-winding device, said torsion spring having two ends that are free ends and that can rotate when actuated by said cord-winding device, said rope ladder fixing ring being actuated by said torsion spring, said bearing seat including a bottom seat frame and an annular sleeve connected to said bottom seat frame to receive said bearing, two connection locations of said annular sleeve that are proximate to a bottom portion of said torsion spring and said bottom seat frame being provided with two limiting pieces having definite widths to limit angular rotation of said two free ends of said torsion spring.

5. The hollow built-in blind as claimed in claim 1, characterized in that said blind actuating device includes a motor and a control circuit board.

6. The hollow built-in blind as claimed in claim 1, characterized in that said blind actuating device includes a magnetic drive mechanism.

7. A hollow built-in blind comprising:

an outer glass, an inner glass, a spacer, and a blind, said blind being installed in a closed space cooperatively defined by said outer glass, said inner glass and said spacer;

wherein said spacer has a cross section with a stepped portion to connect with said blind, said stepped portion forming a recess between said spacer and said inner glass;

said blind including a fixing device, said fixing device including an upper rail having a cross section with a projection, and left and right frames each having a cross section with a projection, said projections of said upper rail and said left and right frames of said blind being placed on said stepped portion of said spacer in said recess as a result of said blind being introduced into said recess along a direction normal to the outer glass before the inner glass is attached to said spacer.

8. A hollow built-in blind according to claim 7, wherein said spacer has a thickness larger than the thickness of said upper rail or said left and right frames of said blind, such that said upper rail and said left and right frames of said blind do not contact said outer glass.

9. A hollow built-in blind comprising:

an outer glass, an inner glass, a spacer, and a blind, said blind being installed in a closed space cooperatively defined by said outer glass, said inner glass and said spacer, said spacer having a cross section with a stepped portion to connect with said blind;

said blind including a fixing device surrounded by said spacer, said fixing device including an upper rail having a cross section with a projection, and left and right frames each having a cross section with a projection, said spacer having an inner side proximate to said inner glass, an outer side proximate to said outer glass, and a four-sided interior surface in contact with said upper rail and said left and right frames, said interior surface being flat and free of any projection, said interior surface and said inner side being indented to cooperatively form said stepped portion at a junction of said interior surface and said inner side, said projections of said upper rail and said left and right frames of said blind being inserted between said stepped portion of said spacer and said inner glass, and being connected to said spacer.

* * * * *